US007988609B2

(12) United States Patent
Peres et al.

(10) Patent No.: US 7,988,609 B2
(45) Date of Patent: Aug. 2, 2011

(54) FOLDING TABLE AND CORRESPONDING CHOPPER FOLDING DEVICE

(75) Inventors: Jéróme Peres, Montataire (FR); Philippe Herda, Nogent sur Oise (FR); Thierry Vauchelle, Maignelay Montigny (FR); Franck Chagnon, Saint Leu d'Esserent (FR); Eric Pierda, Saint Leu d'Esserent (FR); Thierry Melon, Breuil le Vert (FR); Mathieu Rossi, Breuil le Vert (FR)

(73) Assignee: Goss International Montataire SA, Montataire (FR)

( * ) Notice: Subject to any disclaimer, the term of this patent is extended or adjusted under 35 U.S.C. 154(b) by 0 days.

(21) Appl. No.: 12/217,257

(22) Filed: Jul. 2, 2008

(65) Prior Publication Data

US 2009/0042708 A1 Feb. 12, 2009

(30) Foreign Application Priority Data

Jul. 3, 2007 (FR) ..... 07 56245

(51) Int. Cl.
*B65G 17/00* (2006.01)
*B31F 1/08* (2006.01)

(52) U.S. Cl. ..... 493/443; 493/444; 493/357; 198/841

(58) Field of Classification Search ..... 493/418, 493/356–58, 405, 416–23, 442–45, 444, 493/449, 1; 270/46; 198/817, 841
See application file for complete search history.

(56) References Cited

U.S. PATENT DOCUMENTS

| | | | | |
|---|---|---|---|---|
| 4,549,728 | A * | 10/1985 | Odeau | 270/46 |
| 4,921,240 | A | 5/1990 | Watson | |
| 5,139,253 | A | 8/1992 | Bohme et al. | |
| 7,490,714 | B2 * | 2/2009 | Krause et al. | 198/817 |
| 7,673,741 | B2 * | 3/2010 | Nemedi | 198/841 |
| 2005/0090932 | A1 | 4/2005 | Belmann et al. | |
| 2006/0081448 | A1 * | 4/2006 | Fandella | 198/805 |

FOREIGN PATENT DOCUMENTS

| | | | |
|---|---|---|---|
| DE | 2638784 | A1 | 3/1978 |
| EP | 0324545 | A | 7/1989 |
| EP | 0453790 | A | 10/1991 |

* cited by examiner

*Primary Examiner* — Rinaldi I. Rada
*Assistant Examiner* — John Paradiso
(74) *Attorney, Agent, or Firm* — Davidson, Davidson & Kappel, LLC

(57) ABSTRACT

A folding table, in particular for a folding device which is provided with a chopper folding device, includes a folding face which is suitable for receiving a flat product to be folded, and a folding aperture which extends in a conveying direction, the table extending along a table plane. The folding face includes guides which are capable of guiding at least one conveyor for conveying a flat product to be folded in the conveying direction.

21 Claims, 2 Drawing Sheets

FOLDING TABLE AND CORRESPONDING CHOPPER FOLDING DEVICE

This claims the benefit of French Patent Application No. 07 56245, filed on Jul. 3, 2007, and hereby incorporated by reference herein.

BACKGROUND TO THE INVENTION

The present invention relates to a folding table, in particular for a folding device which is provided with a chopper folding device.

Chopper folding devices are known which are suitable for folding a flat product, such as a sheet or a signature which has been printed in a rotary offset press.

These chopper folding devices comprise a folding table, folding rollers and a folding blade. The folding blade is used in order to push the flat products through an aperture which is provided in the table in a gap which is formed by the rollers. The chopper folding device is provided with belts for conveying the flat product in order to convey it onto the folding table.

During the folding operation, the conveying belts are driven by the product to be folded in a transverse direction relative to the conveying direction thereof. Consequently, the belts overlap in a transverse manner and produce occurrences of jamming.

The machine time of known chopper folding devices is therefore low.

The object of the invention is to increase the machine time of a folding device, in particular a chopper folding device.

SUMMARY OF THE INVENTION

To this end, the invention provides a folding table, in particular for a folding device which is provided with a chopper folding device, wherein the folding face includes at least one element for conveying a flat product to be folded in the conveying direction, and guiding means, the guiding means being capable of guiding the at least one element for conveying a flat product.

According to specific embodiments, the folding table may include one or more of the following features:

the table includes a base body and the guiding means includes at least one guiding element which is arranged on the base body and the base body and the at least one guiding element form the folding face;

the at least one guiding element is a guiding rib;

the at least one guiding element is produced in one piece, in particular integrally, with the base body; and the folding face includes an anti-friction coating, in particular of chromium.

The invention also provides a chopper folding device, of the type including:

a folding table, and at least one element for conveying a flat product to be folded, in particular a conveying belt, wherein the folding table is a folding table, and the at least one conveying element is guided by the at least one guiding elements.

According to specific embodiments, the chopper folding device includes one or more of the following features:

the at least one conveying element has a first height and the at least one guiding element has a second height, these heights being measured perpendicularly relative to the table plane, and the second height is less than or equal to the first height;

the second height is strictly less than the first height, and in particular the second height is between 0.5 and 0.8 times the first height;

the at least one guiding element forms at least one guiding channel in which a conveying element is arranged, in particular a single conveying element;

the at least one guiding element is arranged between the folding aperture and the associated conveying element.

Other aspects and advantages of the invention will be appreciated from the following description, given by way of example and with reference to the appended drawings.

DETAILED DESCRIPTION OF THE INVENTION

Figure 1:
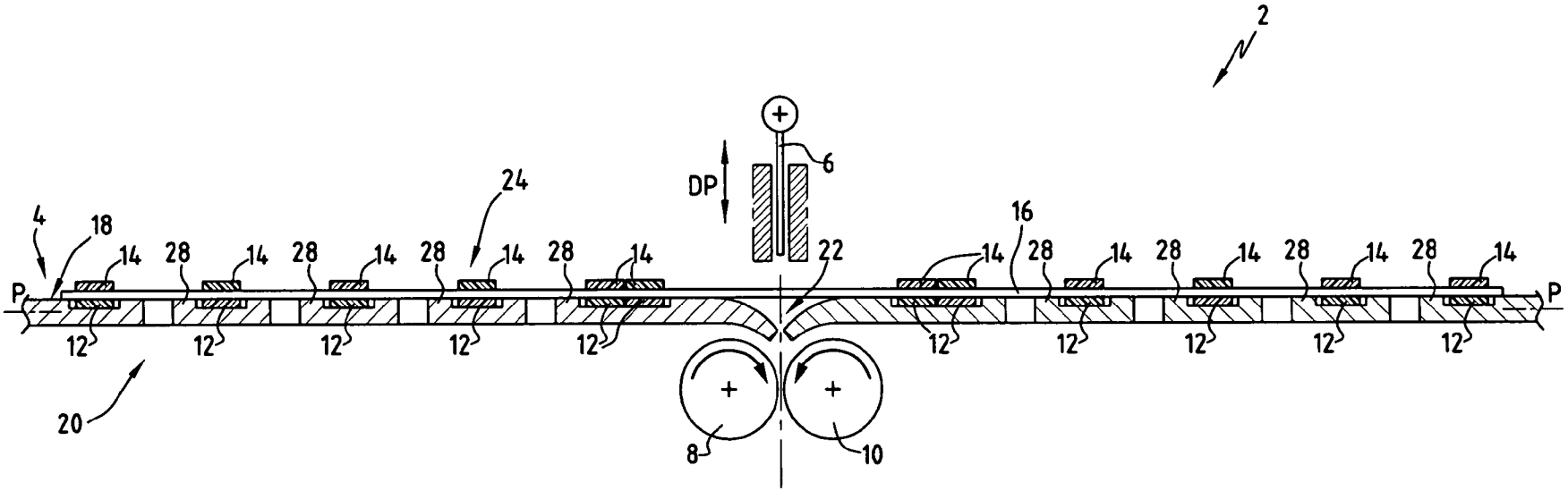
FIG. 1 is a section through a chopper folding device according to the invention.

FIG. 1 is a cross-section through the chopper folding device according to the invention, generally designated 2.

The chopper folding device 2 includes a folding table 4, a folding blade 6 and two folding rollers 8, 10.

The folding blade 6 can be moved back and forth in a folding direction DP and is arranged at one side of the folding table 4. The two folding rollers 8, 10 have parallel axes and together form a folding gap.

Figure 2:
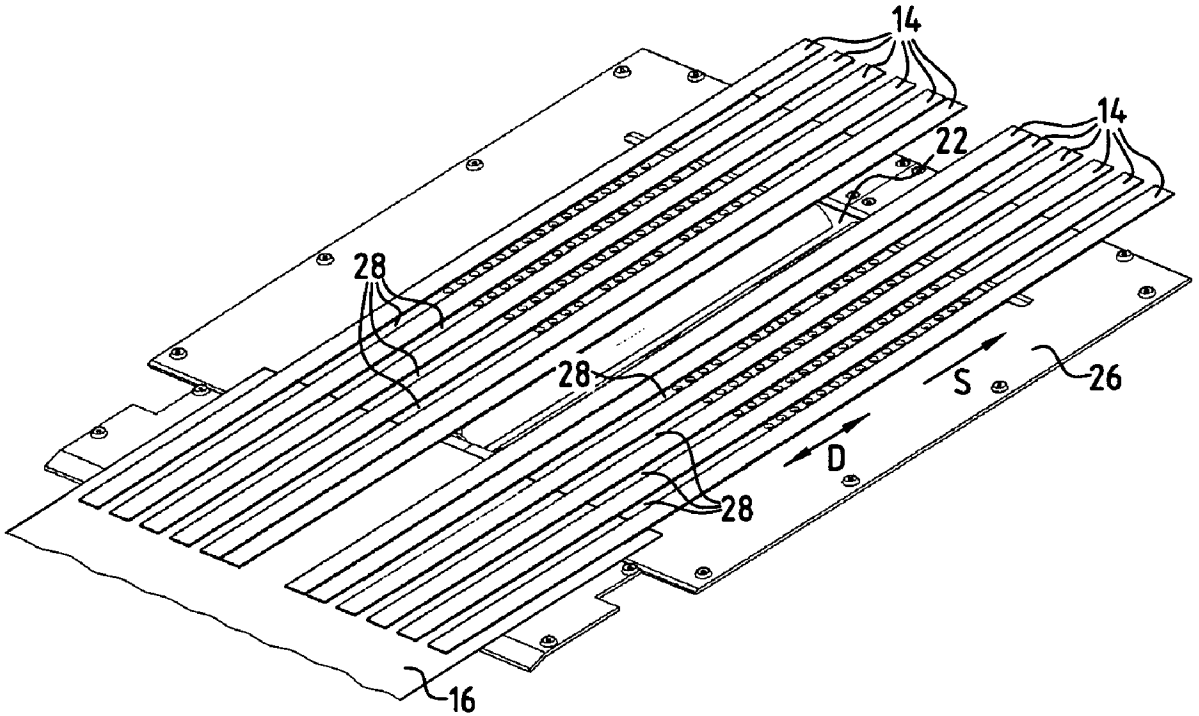
FIG. 2 is a perspective view of the chopper folding device according to the invention.

The chopper folding device 2 includes lower conveying belts 12 and upper conveying belts 14. The conveying belts 12 and 14 are capable of conveying flat products 16 to be folded, such as signatures or sheets, onto the folding table 4 in a conveying direction D and in a conveying direction S (see FIG. 2). To this end, the conveying belts 12 and 14 extend parallel with respect to the conveying direction D and are driven in the conveying direction S.

The folding table 4 includes a folding face 18 which is directed towards the folding blade 6 and a lower face 20 which is directed towards the folding rollers 8, 10.

The folding table 4 delimits a folding aperture 22 through which the products 16 to be folded are pushed by the blade 6. The folding aperture 22 extends parallel with the conveying direction D.

The folding table 4 is provided with means 24, for example, guides, for guiding the lower conveying belts 12 in the conveying direction D. These guiding means 24 are capable of acting counter to a deflection of the lower conveying belts 12 towards the folding aperture 22, therefore transversely relative to the direction D, when the product 16 to be folded is pushed by the folding blade 6 through the folding aperture 22.

To this end, the folding table 4 includes a base body 26 and guiding ribs 28 which extend in the conveying direction D.

The base body 26 is generally parellelepipedal. The ribs 28 are arranged on the base body 26 and form the guiding means 24.

The ribs 28 and the base body 26 form the folding face 18.

Figure 3:
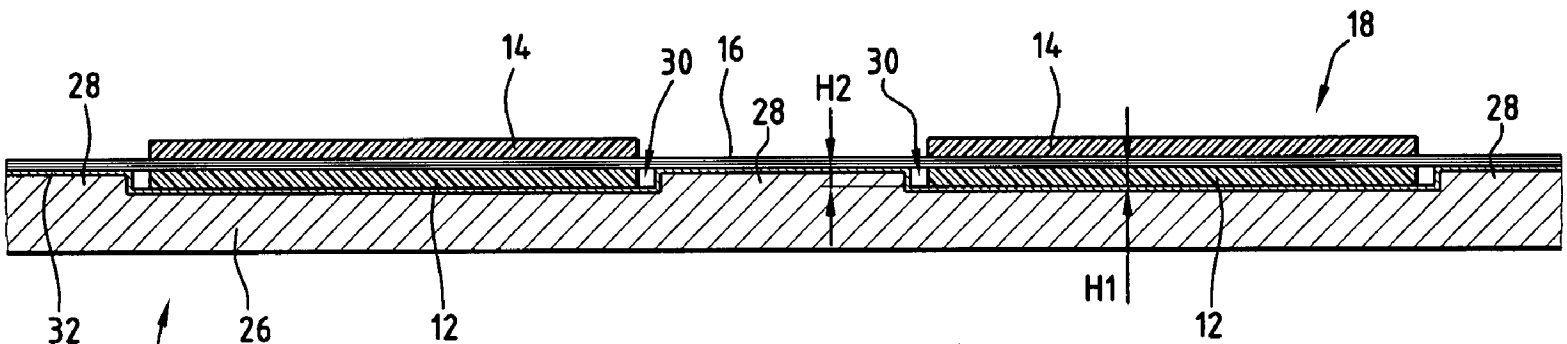
FIG. 3 is a section, drawn to a larger scale, through a portion of the chopper folding device according to the invention.

Two adjacent guiding ribs 28 together form a guiding channel 30 (see FIG. 3) in which either a lower conveying belt 12 or a plurality of lower conveying belts 12 extend(s). Furthermore, the conveying channel 30 closest to the folding aperture 22 receives two lower conveying belts 12. The two conveying belts 12 in the same conveying channel, at one side and the other of the folding blade 6, are used to provide better guiding and better retention during the operation for folding books, signatures, sheets, in particular narrow sheets (web of paper having a small width).

Each guiding rib 28 is thus arranged between the associated lower conveying belt 12 and the folding aperture 22 in order to be able to guide the belt 12 during the folding operation.

The lower conveying belts 12 have a first height H1, measured perpendicularly relative to the table plane P, and each guiding rib 28 has a second height H2 which is also measured perpendicularly relative to the table plane P. Advantageously, the second height H2 is less than, identical to, or strictly less than the height H1 in order not to impede the folding of the product 16 to be folded. In particular, the guiding rib 28 has a height H2 which is between 0.5 and 0.8 times the first height H1 and thus contributes to supporting the product 16 to be folded during the conveying operation.

Furthermore, the base body 26 and the ribs 28 are provided with an anti-friction coating 32 which is advantageously produced from, for example, chromium. This coating 32 promotes the sliding of the conveying belts 12 and products to be folded on the table 4.

It should be noted that, if the coating 32 is present, the second height H2 is measured from the free surface of the coating 32 of the base body 26 to the free surface of the coating 32 of the rib 28.

Also, the guiding ribs 28 are produced in one piece and in particular integrally with the base body 26 which may reduce the production costs of the folding device.

The base body 26 and the ribs 28 are produced, for example, from steel or aluminium.

The folding table according to the invention, using simple and economic means, may reduce the risk of jamming for chopper folding devices and thus may increase the reliability of the folding device.

It should be noted that the conveying belts 12, 14 may be replaced with other conveying elements.

What is claimed is:

1. A folding table comprising:

a folding face suitable for receiving a flat product to be folded;

a folding aperture extending in a conveying direction, the table defining and extending along a table plane, the folding face including at least one conveyor for conveying a flat product to be folded in the conveying direction, and guides forming guiding channels including a first guide channel closest to the folding aperture; and the at least one conveyor including a plurality of lower conveying belts guided by the guiding channels, the first guiding channel closest to the folding aperture receiving two of the plurality of lower conveying belts.

2. The folding table according to claim 1 wherein the table includes a base body and the guides include at least one guiding element being arranged on the base body, the base body and the at least one guiding element forming the folding face.

3. The folding table according to claim 2 wherein the at least one guiding element is a guiding rib.

4. The folding table according to claim 2 wherein the at least one guiding element includes a plurality of guiding ribs and each guiding channel is formed by two adjacent guiding ribs.

5. The folding table according to claim 3 wherein the guiding rib is produced in one piece.

6. The folding table according to claim 5 wherein the guiding rib is produced integrally, with the base body.

7. The folding table according to claim 2 wherein the at least one guiding element is produced in one piece.

8. The folding table according to claim 7 wherein the at least one guiding element is produced integrally, with the base body.

9. The folding table according to claim 2 wherein the folding face includes an anti-friction coating.

10. The folding table according to claim 9 wherein the anti-friction coating includes chromium.

11. The folding table according to claim 1 wherein the folding face includes an anti-friction coating.

12. The folding table according to claim 11 wherein the anti-friction coating includes chromium.

13. The folding table according to claim 1 wherein the folding table is for a folding device including a chopper folding device.

14. The folding table as recited in claim 1 wherein a further guide channel of the plurality of guide channels includes a further single lower conveying belt of the plurality of lower conveying belts.

15. A chopper folding device comprising:

a folding table in accordance with claim 1; and the at least one conveyor being guided by at least one guiding element.

16. The chopper folding device according to claim 15 wherein the at least one conveyor has a first height and the at least one guiding element has a second height, the first and second heights being measured perpendicularly relative to the table plane, the second height being less than or equal to the first height.

17. The chopper folding device according to claim 16 wherein the second height is strictly less than the first height.

18. The chopper folding device according to claim 17 wherein the second height is between 0.5 and 0.8 times the first height.

19. The chopper folding device according to claim 17 wherein the at least one guiding element includes a plurality of guiding elements forming the guiding channels.

20. The chopper folding device according to claim 19 wherein the at least one guiding element is arranged between the folding aperture and the associated conveyor.

21. The chopper folding device according to claim 17 wherein a single conveyor is arranged in another one of the guiding channels different from the first guiding channel.

* * * * *